United States Patent [19]

Hodsall

[11] 4,330,001

[45] May 18, 1982

[54] CIGARETTE MAKING MACHINE HOPPER

[75] Inventor: Brian A. Hodsall, London, England

[73] Assignee: Molins Limited, London, England

[21] Appl. No.: 129,305

[22] Filed: Mar. 11, 1980

[30] Foreign Application Priority Data

Mar. 16, 1979 [GB] United Kingdom ..... 7909303

[51] Int. Cl.[3] ..... A24C 5/39; A24C 5/14

[52] U.S. Cl. ..... 131/108; 131/109 R; 131/909; 131/109 B

[58] Field of Search ..... 131/21 A, 108–110, 131/909

[56] References Cited

U.S. PATENT DOCUMENTS

| | | | |
|---|---|---|---|
| 2,367,060 | 1/1945 | Ruau | 131/109 B |
| 3,030,966 | 4/1962 | Lanore | 131/84 R |
| 3,757,800 | 9/1973 | David et al. | 131/21 A |
| 4,172,515 | 10/1979 | Wochnowski | 131/21 A |
| 4,220,164 | 9/1980 | Lorenzen | 131/21 A |

FOREIGN PATENT DOCUMENTS

| | | | |
|---|---|---|---|
| 549397 | 11/1942 | United Kingdom | 131/84 R |

*Primary Examiner*—Vincent Millin

*Attorney, Agent, or Firm*—John C. Smith, Jr.

[57] ABSTRACT

A hopper for a cigarette making machine includes an elevator, conveying means for conveying a carpet of tobacco towards the elevator, whereby the elevator carries upwards a stream of tobacco from the carpet, and a photoelectric or other position-sensing device mounted near the elevator at a position such that it detects upward movement of tobacco from the carpet in a vicinity adjacent to the elevator indicative of the start of rolling; and including means for temporarily stopping or reducing the speed of conveyance of the tobacco carpet towards the elevator to obviate the rolling condition.

8 Claims, 1 Drawing Figure

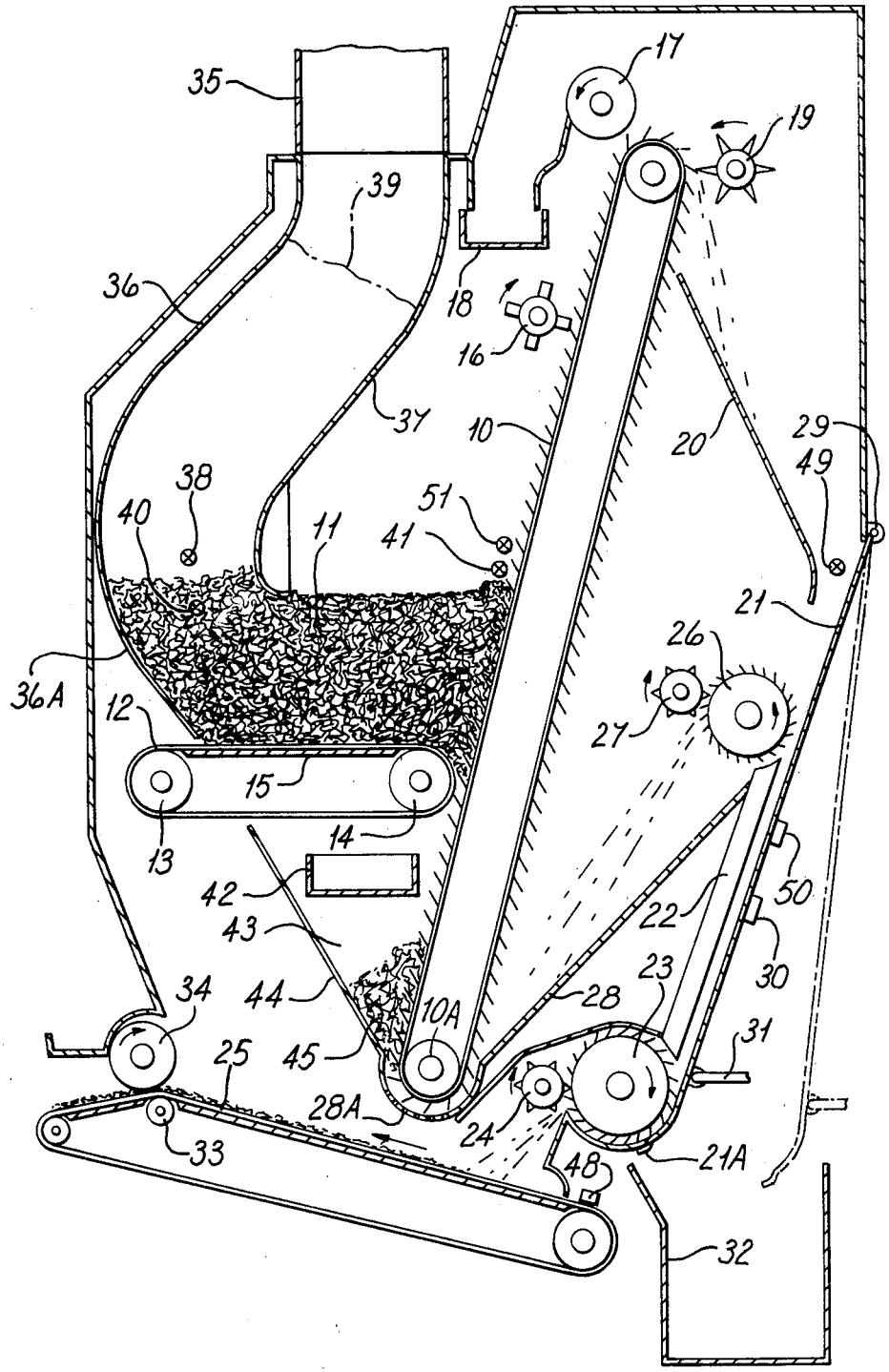
35
17
19
39
36
18
16
37
10
20
29
49
38
40
51
41
11
21
26
36A
12
27
15
14
13
42
50
43
22
30
44
23
34
28
10A
31
25
45
28A
24
21A
33
48
32

CIGARETTE MAKING MACHINE HOPPER

U.S. Pat. No. 4,214,595, issued July 29, 1980 to Labbe et al. (and corresponding German Offenlegungsschrift Nov. 27 24 596 published Dec. 15, 1977) describes a hopper for a cigarette making machine including an elevator, a conveyor for conveying a carpet of tobacco approximately horizontally towards the elevator, and means for detecting the start of a rolling motion of the tobacco on the conveyor caused by the upward movement of the elevator. When rolling is detected, the conveyor is stopped or slowed down automatically to obviate the rolling condition, thus minimizing tobacco degradation while ensuring substantially even filling of the elevator. In the particular arrangement described in the above specification, a roller device is used for detecting a rolling condition. The present invention is concerned with a different means of detecting rolling.

According to the present invention, a hopper for a cigarette making machine includes an elevator; conveying means for conveying a carpet of tobacco towards the elevator, whereby the elevator carries upwards a stream of tobacco from the carpet; and a position sensing device mounted near the elevator at a position such that it detects an increase in the height of the upper surface of the carpet near the elevator which indicates that the tobacco in the carpet is starting to roll, the conveyance of the tobacco carpet towards the elevator being automatically stopped or reduced in speed in response to the position sensing device.

This invention is based upon a realization that the start of rolling in a suitably designed hopper is indicated by a pronounced upward movement of a mass of tobacco adjacent to the elevator. Rolling can be detected simply by means of a light beam directed horizontally across the top of the tobacco carpet near the elevator, with a cooperating photoelectric device from which a signal can be generated whenever the light beam which normally arrives at the photoelectric device is interrupted; alternatively some other form of position-sensing device can in principle be used in place of a photoelectric device.

An example of a hopper according to this invention is shown in the accompanying drawing, which is a diagrammatic side view of the hopper.

The hopper includes a spiked elevator band 10 which may be constructed as shown in FIGS. 9 and 10 of our above-mentioned patent. A carpet of tobacco 11 is fed towards the elevator band by a smooth band 12 which passes around pulleys 13 and 14 and has its upper run supported by a plate 15; the carpet shown is relatively thick (about 20 cms) but it may be somewhat thinner, e.g. down to about 15 cms. The elevator 10 carries upwards from the carpet 11 a substantially uniform stream of tobacco which is eventually fed to a device (not shown) for forming a cigarette filler stream.

A doffer roller 16 knocks off the elevator any protruding lumps of tobacco, while a rotating magnet 17 extracts any ferrous foreign bodies in the tobacco, these foreign bodies being deposited in a receptacle 18 from which they can be removed from time to time. A spiked roller 19 helps to remove the tobacco from the elevator, and the tobacco slides down a ramp 20 and then onto a wall 21 serving as a ramp. A downward extension of this wall 21 forms, together with a wall 22, a downwardly extending channel in which a column of the tobacco builds up. Tobacco is fed continuously from the lower end of the channel by a spiked drum 23 and is then removed from the drum 23 by a picker roller 24 which projects the tobacco downwards onto a relatively fast-moving band 25.

A spiked drum 26 is mounted close to the ramp 21 and is arranged to pick up any significant lumps of tobacco while allowing loose tobacco to slide down the wall 21 and into the channel below. A picker roller 27 removes the tobacco lumps from the spiked roller 26 and projects the lumps downwards with a vigorous action which tends to open up the lumps. The opened up tobacco then slides down a wall 28 and is picked up by the elevator band 10.

A curved extension 28A of the wall 28 extends around a lower pulley 10A for the elevator band and may be perforated to allow tobacco shorts to drop through it and onto the band 25. An anti-static device 48 is fitted close to the upstream end of the band 25, as shown, to eliminate static electricity on the band.

The wall 21 forming the rear wall of the channel is pivoted at 29 so that it can swing outwards (to the position shown in broken outline) to allow clearance of any choke or foreign body in the channel. A detector 30 (e.g. of a capacitance measuring type) may be provided to detect the presence of a solid foreign body in the channel and to cause the wall 21 to swing outwards automatically, e.g. by means of an actuator 31. The tobacco and any foreign body falling out of the channel when the wall 21 is swung backwards is collected in a container 32. It should be noted that the lower end of the wall extends part of the way around the drum 23 (to the point 21A) so that movement of the wall about the pivot 29 tends to clear away tobacco near the entrance to the drum 23. Also, a photodetector 49 is included to detect the occurrence of a tobacco choke in that area (i.e. as shown by a build-up of tobacco so as to cover the detector 49) and to operate the actuator 31 to clear the choke.

The rod-forming part of the machine may be arranged to stop automatically shortly after the actuator is operated to swing outwards the wall 21. The actuator may be arranged to return the wall 21 automatically after a predetermined short interval after which rod-making can be re-started.

The upper run of the band 25 carrying the tobacco carpet bends around a pulley 33, the carpet of tobacco on the band 25 being constrained to move along the band by a roller 34 rotating with a peripheral speed slightly greater than the speed of the band; the roller 34 may be omitted if the velocity of the band 25 is relatively low (e.g. about 10 cms per second) unless the roller is needed to form an air seal. This allows the carpet to be projected from the left-hand end of the band 25 in a slightly downward direction; however, the main part of the upper run of the band moves obliquely upwards, which allows the elevator 10, channel 21, 22 and the cooperating parts to be placed lower than would otherwise be possible.

Tobacco forming the carpet 11 on the slow-moving band 12 is delivered from a pneumatic discharge unit 35 which may be as described in U.S. patent application Ser. No. 902,969 filed May 4, 1978 by J. A. Rakowicz et al. (and corresponding German Offenlegungsschrift No. 28 19 705 published Nov. 16, 1978). On leaving the discharge unit 35, the tobacco passes as a thick carpet through a passageway formed by walls 36 and 37 which are spaced apart by a distance which slightly increases progressively towards the lower end of the walls 36, 37.

The lower end portion 36A of the wall 36 approaches the band 12 obliquely so as to guide the tobacco carpet 11 smoothly onto the band.

The discharge unit is arranged to discharge a quantity of tobacco in response to a photoelectric or other detector 38 when the level of tobacco falls below the detector 38. The quantity of tobacco discharged at each delivery is sufficient to fill the passage 36, 37 approximately up to the level shown in chain-dotted outline 39. If the level of tobacco falls below a further detector 40, the machine is automatically switched off.

A further photoelectric or other detector 41 is mounted close to the elevator at a height such that it detects the start of a rolling motion of the tobacco adjacent to the elevator. When a horizontal beam of light directed towards the detector 41 is interrupted by the tobacco, indicating the start of rolling, a motor driving the band 12 is automatically slowed down either for a pre set period or until such time as the light beam is no longer interrupted by tobacco. For example, the band 15 may have a maximum speed of about 60 centimeters/minute; when the start of rolling is detected by the detector 41 the speed may be reduced by nearly 50%. Furthermore, the speed of the elevator may be continuously varied in any known manner (e.g. by means of a detector 50 or by a group of detectors) to maintain a desired height of tobacco in the channel; and when the elevator speed is reduced below its maximum, the speed of the band 12 may be reduced proportionally by an appropriate electronic circuit of any conventional type.

A second detector 51 may in addition be mounted above the detector 41 to switch off the drive to the band 12 when the tobacco covers that detector. The detectors may be adjustable as to their positions along the detector band 10.

Discard tobacco removed from the cigarette filler stream is returned to the hopper (by any known means), being received by a vibratory conveyor 42 which extends across a space 43 between the lower end of the band 10 and a downwardly inclined wall 44. The conveyor 42 has an inclined slot in its floor whereby the discard tobacco is spread substantially evenly across at least part of the space 43. Thus the discard tobacco 45 is picked up by the elevator 10, partly filling the pins, scalloped slats or equivalent tobacco-carrying elements on the elevator 10, these elements being more completely filled on passing through the carpet 11.

In addition to being pivotable as a whole about the pivot 29 to clear chokes and foreign bodies, the wall 21 may include a small pivotable insert above the drum 26 which is arranged to swing inwards to deflect the tobacco onto the drum 26 as soon as tobacco is required to stop entering the channel for any reason. For that purpose the insert would be pivoted at its upper end and would be controlled by an actuator so that it either forms a smooth continuation of the inner surface of the wall 21 or is inwardly inclined by a small angle to deflect the tobacco so that it becomes caught on the spikes of the drum and is thus returned to the elevator.

I claim:

1. A hopper for a cigarette-making machine comprising (a) an elevator having a surface for receiving and carrying a stream of tobacco upwardly;

(b) conveying means for conveying a carpet of tobacco along a path towards said elevator to a position immediately adjacent said elevator surface for transfer of said tobacco directly from said conveying means to said elevator surface;

(c) means for forming said tobacco carpet of substantially uniform, predetermined height on said conveying means at a further position along said path spaced from said elevator; and (d) a position-sensing device connected to said conveying means and mounted at a position adjacent said elevator surface for detecting an increase in the height of the upper surface of said tobacco carpet near said elevator surface which indicates that said tobacco in said carpet is starting to roll and, upon detection of said height increase, for automatically stopping or reducing the speed of said conveying means and the conveyance of said tobacco carpet towards said elevator.

2. A hopper according to claim 1 in which the position-sensing device comprises a photoelectric device mounted on one side of the elevator, and a source of light for directing a beam of light towards the photoelectric device from the other side of the elevator.

3. A hopper according to claim 1 or claim 2 in which there is a second position-sensing device mounted above the first-mentioned position-sensing device and connected to said conveying means, and in which the first-mentioned device is arranged to slow down said conveying means and the speed of conveyance of the tobacco carpet when the upper surface of the tobacco carpet near said elevator surface reaches a first upper limit whereas the second device is arranged to stop said conveying means and the conveyance of the tobacco carpet when the upper surface of the tobacco carpet near the elevator surface reaches a second upper limit.

4. A hopper according to any one of claim 1 or claim 2 in which the conveying means comprises a conveyor band.

5. A hopper according to claim 4 in which said means for forming said tobacco carpet comprises substantially parallel walls spaced from each other for feeding said tobacco as a carpet therebetween onto said conveyor band.

6. A hopper according to claim 1 in which the elevator is in the form of a band carrying pins, scalloped slats or other tobacco-carrying elements.

7. A hopper according to claim 6 in which the elevator band is inclined to the vertical in a direction away from the carpet conveying means.

8. A hopper according to claim 1 wherein said path of said conveying means is substantially horizontal.

* * * * *